United States Patent [19]

De Méré

[11] 3,986,814

[45] Oct. 19, 1976

[54] DEVICE FOR AUTOMATICALLY CONTROLLING A GASEOUS OR LIQUID FUEL FIRED APPLIANCE

[75] Inventor: Henri Courier De Méré, Paris, France

[73] Assignee: Bicosa-Societe de Recherches, Clichy, France

[22] Filed: Oct. 1, 1975

[21] Appl. No.: 618,314

[30] Foreign Application Priority Data

Oct. 4, 1974 France ..... 74.33548

[52] U.S. Cl. ..... 431/72; 431/62; 431/79; 431/80

[51] Int. Cl.[2] ..... F23N 5/08

[58] Field of Search ..... 431/72, 78, 79, 80, 431/62, 63, 74; 236/15 R, 15 B

[56] References Cited

UNITED STATES PATENTS 3,301,307 1/1967 Nishigaki et al. ..... 431/78 X 3,393,868 7/1968 Griem ..... 431/62 X

*Primary Examiner*—Edward G. Favors

*Attorney, Agent, or Firm*—Michael J. Striker

[57] ABSTRACT

A device for controlling a gaseous or liquid fuel fired appliance as a function of a parameter includes a fuel supply controlled by a valve operated in dependence on a signal furnished by means sensitive to the parameter. The device includes a first circuit triggerable by the parameter-sensitive means when the parameter exceeds a first value and a second circuit triggerable by the parameter-sensitive means when the parameter falls below a second value lower than the first value. These circuits operate the valve appropriately for a given period of time. The device includes a spark generator for ignition of the fuel and an inhibitor to stop spark generation on fuel ignition. The device also includes first and second dc sources for independent supply of the first and second circuits, which require negligible current when not operative.

8 Claims, 4 Drawing Figures

DEVICE FOR AUTOMATICALLY CONTROLLING A GASEOUS OR LIQUID FUEL FIRED APPLIANCE

FIELD OF THE INVENTION

This invention relates to a device for automatically controlling a gaseous or liquid fuel fired appliance as a function of a parameter. This parameter may for example be a degree of illumination or a temperature and for the former the invention applies particularly to a device for automatic control of lighting and extinguishing a combustion lighting system at given levels of lighting. For the latter, the invention applies particularly to a device for automatic control of lighting and extinguishing a heating or cooling system or a control system at a given temperature.

The invention may have applications such as automatic control of lighting beacons placed in not readily accessible locations; night-time illumination of advertising installations; and night-time working site illumination; and their extinction by day.

In cases where the parameter is temperature, the automatic control device of the invention may be used to regulate the temperature of a furnace.

When a lighting installation is required to function independently for long periods, the use of a liquid fuel may be preferable to the use of electricity: indeed, in view of the good lighting efficiency which can be achieved with burners fitted with Auer sleeves, the autonomy of such a burner system is greater than that of a system using batteries or accumulators. On the other hand, starting of the installation calls for two operations, firstly supply of fuel to the burner and secondly ignition of the flame.

The invention sets out to resolve this problem by means of a device which consumes electricity at a low rate, so that it can operate independently for a long time. The same low consumption advantages are sought if the parameter is the temperature.

SUMMARY OF THE INVENTION

According to this invention a device for automatically controlling a gaseous or liquid fuel fired appliance as a function of a parameter, comprises:

fuel supply means provided with valve means having a reversible electric motor, operation of which in one direction drives the valve means in the opening direction and in the opposite direction drives the valve means in the closing direction;

means sensitive to the said parameter to furnish an electrical signal which is a function of the value of the said parameter;

a first circuit adapted to be triggered by the said parameter-sensitive means when the value of the parameter exceeds a first threshold and adapted to supply the motor for a given period of time in the direction corresponding to closure of the valve means;

a second circuit adapted to be triggered by the said parameter-sensitive means when the value of the parameter falls below a second threshold which is lower than the first threshold, and adapted to supply the said motor then for a definite period in the direction corresponding to opening of the valve means;

a spark generator to ignite the combustible and adapted to be brought into operation by the said second circuit;

an inhibiting element adapted to stop the spark generator when the combustible is ignited, and first and second dc sources for independently and respectively supplying the first and second circuits;

the said first and second circuits being so arranged that outside the said definite period and the said predetermined period, their consumption of electric power is low.

The device of the invention may also comprise first and second independent dc supplies to feed respectively the first and the second circuits. Further, these circuits may be so arranged that, outside the said determined period and the said predetermined period, their consumption of electric power is low.

The term 'motor' is to be interpreted in a wide sense as designating both a conventional motor which can be driven in one direction or the other and an electrically operated valve having only two positions of stable balance (open and closed) and associated with operating means, the valve returning automatically to one of these positions if it is brought to a mid position.

It is advantageous for the first and/or second circuits to comprise an element which is sensitive to the said parameter and the resistance of which varies as a function of this parameter, this element being disposed in series with an adjustable resistance and a low holding current controlled rectifier, for example a thyristor, in the base polarising circuit of a transistor; this controlled rectifier is likewise disposed in the collector circuit of the said transistor and the said parameter-sensitive element is mounted so that it will put the transistor in its conductive state when the parameter exceeds the value of the first threshold or falls below the value of the second threshold.

DESCRIPTION OF THE PREFERRED EMBODIMENTS

The embodiments now to be described relate to cases in which the parameter in question is the ambient lighting. However, transposition to the case in which the parameter is temperature is readily possible to one skilled in the art. For example, photosensitive means such as photodiodes could be replaced by thermistors or other temperature-sensitive elements.

Figure 1:
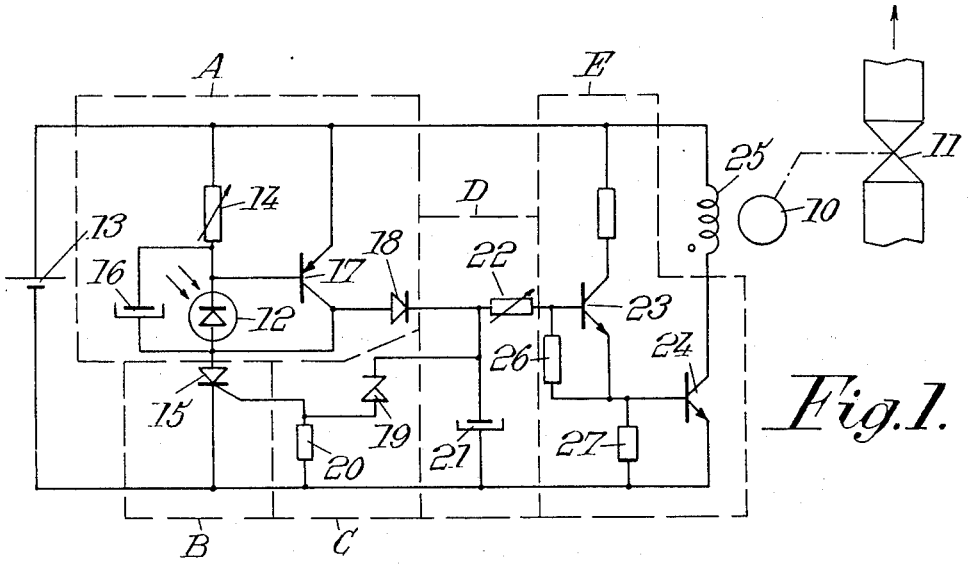
FIG. 1 is a circuit diagram showing the principle of the extinction portion of a first device according to the invention.
Figure 2:
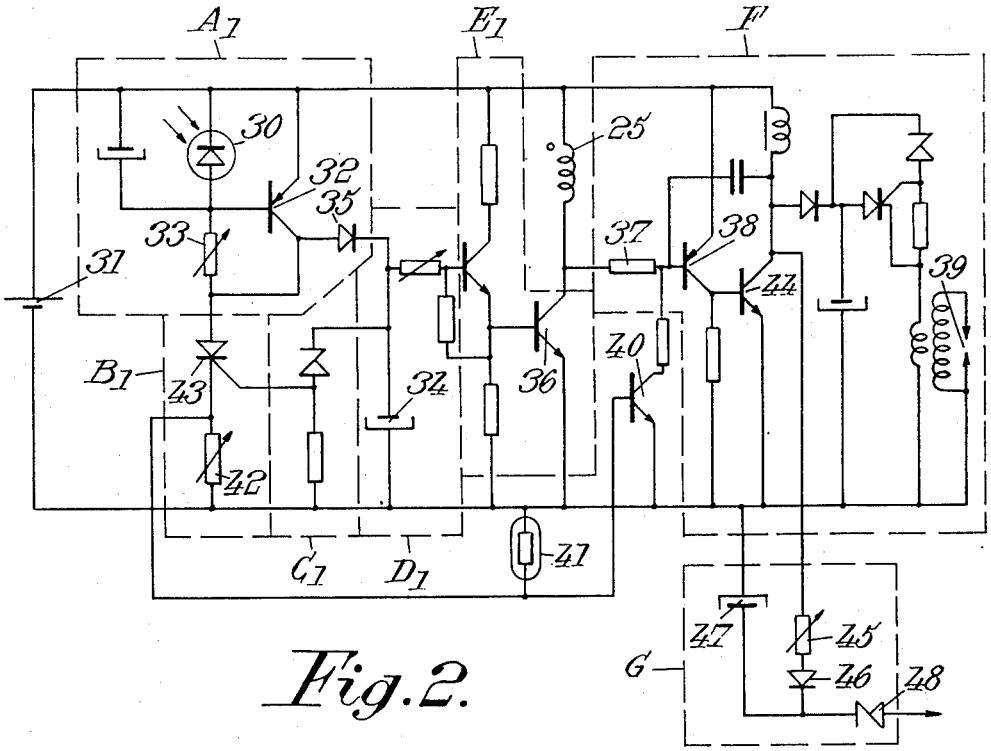
FIG. 2 is a circuit diagram showing the principle of the ignition portion of said first device.

The ignition and extinction portions of the control device shown in FIGS. 1 and 2 comprise similar assemblies, at least with regard to control of a reversible motor 10 coupled to a valve 11 disposed in a gas supply line to a lighting jet (not shown). The gas may be for example methane, butane or propane, for which a suitable burner nozzle is used and for which sparks of sufficient strength are provided to initiate combustion.

The constituent elements of the circuit of FIG. 1 may be regarded as constituting several sub-assemblies which will be successively described and which are depicted diagrammatically by broken line frames.

A high threshold light detector A comprises a photosensitive element in the form of a photo-diode 12 responsive to ambient lighting. This photo-diode is inversely polarised by a dc source 13. This source may consist of accumulators but, particularly when a period of autonomous operation is long, it is preferable to use long life, cold-resistant cell batteries, such as batteries which employ cadmium-mercury oxide pairing.

The light detector A also has, in series with the photo-diode 12, an adjustable triggering-threshold regulating resistance 14 and a thyristor 15. To reduce the sensitivity of the photo-diode 12 to light pulses of brief duration, a capacitor 16 is connected in parallel with it. The base of a transistor 17 is polarised by the potential between the resistance 14 and the cathode of the photo-diode 12. The other electrodes of the transistor 17 are connected: one to the positive pole of the supply, the other to the anode of the photo-diode 12 and also to a unidirectional conduction element, such as a diode 18.

The anode of the diode 12 is connected to the negative pole of the high voltage supply by the thyristor 15 polarised directly and constituting low consumption bistable flip-flop B.

This bistable flip-flop is associated with a trigger circuit C which comprises a Zener diode 19 connected to the gate of the thyristor 15 decoupled to the negative pole of the supply 13 by a resistance 20.

A time-lag circuit D which determines the time of operation of the motor 10 consists in conventional manner of a storage capacitor 21 and an adjustable resistance 22 which fixes the discharge time constant of the capacitor. Finally, a power stage E to control the motor 10 comprises two amplifying transistors 23, 24 connected in cascade. The winding 25 of the motor 10 is in the collector circuit of the second transistor 24.

When the level of lighting to which the photo-diode 12 is subjected exceeds the value for which the leakage current of the photo-diode is set, the leakage current in the resistance 14 polarises the base of the transistor 17 which becomes unblocked (conductive state). The current through this transistor passes through the diode 18 which is directly connected to and progressively charges the storage capacitor 21. When the charge voltage of the capacitor 21 reaches a level so as to operate the Zener diode 19, the latter polarises the gate of the thyristor 15 which is released, branches the current from the thyristor 17, and stops charging of the capacitor 21.

As soon as the charging voltage of the capacitor 21 has reached a value which gets the transistor 23 in its conductive state, the motor 25 is supplied with current. This supply continues, once the Zener diode 19 has been started, as long as the voltage at the terminals of the capacitor 21 (which discharges only via the circuit constituted by the resistances 22, 26 and 27, the diode 18 preventing the return supply) remains higher than the value which corresponds to release (transition from the "off" to the "on" state) of the transistor 23, and the winding 25 is supplied in a direction which corresponds to the direction of rotation of the motor required to close the valve 11. By means of the resistance 22, this period is adjusted to a value such that the valve moves definitely from its fully open position to its fully closed position.

The adjustable resistance 14 is so regulated that the base-emitter current of the transistor 17 is relatively low. More particularly, the resistance 14 is adjusted so that during daytime periods the emitter-collector current of the transistor 17 does not exceed 0.1 milliamps, the thyristor 15 remaining conductive.

Once the capacitor is discharged, the thyristor 15 ceases to be conductive when the current passing through the transistor 17 has returned to zero, that is to say when the photo-diode 12 is no longer exposed to sufficient light (during a night-time period). In this case, the consumption of the device is negligible.

FIG. 2, which shows a portion of the device intended for the ignition phase, has sub-assemblies corresponding to those in FIG. 1 and which, are designated by the same reference numerals, qualified by the index 1. For simplicity, only those sub-assemblies which are different from those in FIG. 1, or which are additional to them, will now be described.

Lighting entails two operations, on the one hand opening of the valve 11 (not shown in FIG. 2) and on the other, production of sparks until at least one flame appears.

The opening of the valve is controlled by a light detector A1 similar to the detector A. It comprises a photo-diode 30 inversely polarised by a supply 31 other than the supply 13. When the photo-diode 30 is exposed to sufficient light, its inverse resistance is low, the base of a transistor 32 is brought to a potential close to that of its emitter and the transistor is blocked.

If the level of lighting is below a low threshold determined by an adjustable resistance 33 (that is, a lighting threshold at a value markedly below the extinction threshold), the internal resistance of the diode 30 increases to such a degree that the transistor 32 is released. The current through the diode 35 and the sub-assemblies B1, C1, D1 and E1 operate as in the circuit of FIG. 1. However, the current passing through the transistor 36 causes a current opposite in sense to that caused by the transistor 24. Consequently, the motor 10 is operated in a direction which opens the valve 11.

The circuit of FIG. 2 also has a flame igniting circuit F, the general arrangement of which is similar to that described in French Pat. No. 72.02407, and in German published Specification No. 2,303,168, to which reference may be made. It is sufficient here to state that the voltage gap which appears at the collector of the transistor 36 and operates the motor 10 is drawn off by a resistance 37 to release the transistor 38. It is not necessary to give a full description of the rest of the circuit F, which is similar to that described with reference to FIG. 4 of the above-mentioned German published Specification. It is necessary only to note that the functioning of the spark arrestor 39 is not controlled by a double switch, but by polarisation of the transistor 38 and that, to the time lag fixed by the time constant of a resistance-capacitance circuit, there is added a time lag which ensures ignition or re-ignition after extinction.

The re-lighting circuit comprises a transistor 40 between the base of the transistor 38 and the negative pole of the supply 31, the base polarisation of which transistor 40, in relation to the negative pole, is fixed by a resistance 41 of negative temperature coefficient exposed to the flame from the nozzle. The commutation temperature of the resistance 41 or CTN is such as to be exceeded in the presence of a flame and not to be reached in the absence of the flame, whatever the ambient conditions. The CTN 41 is in parallel with an adjustable resistance 42 mounted in series with the thyristor 43 (corresponding to the thyristor 15 in FIG. 1). This resistance 42 is adjustable to fix the release temperature of the transistor 40. It can be seen that the CTN 41 maintains the transistor 40 released so long as it is not exposed to a flame while the photo-diode 30 is illuminated by only a level of lighting which is below the threshold. The transistor 40 in turn maintains the transistor 38 released so that sparks occur at the sparking device 39.

The circuit of FIG. 2 comprises also a security system intended, in the event of there being no ignition of the sparking device 39 at the end of a specified period (30 seconds for example), to interrupt the supply of gas to the nozzle. This security system comprises, disposed in cascade between the collector of the transistor 44 and the negative pole of the supply 31, an adjustable resistance 45, a diode 46 and a capacitor 47. The resistance 45 and the capacitor 47 constitute a time constant circuit. When the voltage across the capacitor 47 reaches a given level corresponding to actuation of a Zener diode 48, the latter transmits a signal to a relay (not shown) which controls closure of a supplementary safety valve in the gas supply to the burner. Other arrangements are possible, for example finally to shut off the gas supply only after a given number of fruitless attempts at ignition.

The device of the invention may be provided in other embodiments. Instead of using two different supplies 13 and 31 (to avoid looping through the winding 25), it would be possible to use one supply with complementary transistors in the circuits of FIGS. 1 and 2. Whichever embodiment is adopted, consumption remains low outside of periods of supply to the motor 10 and of spark production.

In one embodiment, the thyristors 15 and 43 are those of the type BRY 55 of the French SESCO Company. Such thyristors have a maintenance current of the order of 40 A. It is also possible to use type BRX 56 thyristors of the I.T.T. Company.

Figure 3:
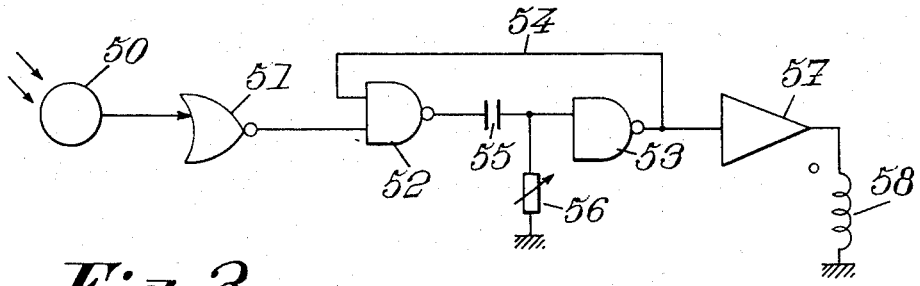
FIG. 3 is a circuit diagram showing the principle of the extinction portion of a second device according to the invention.
Figure 4:
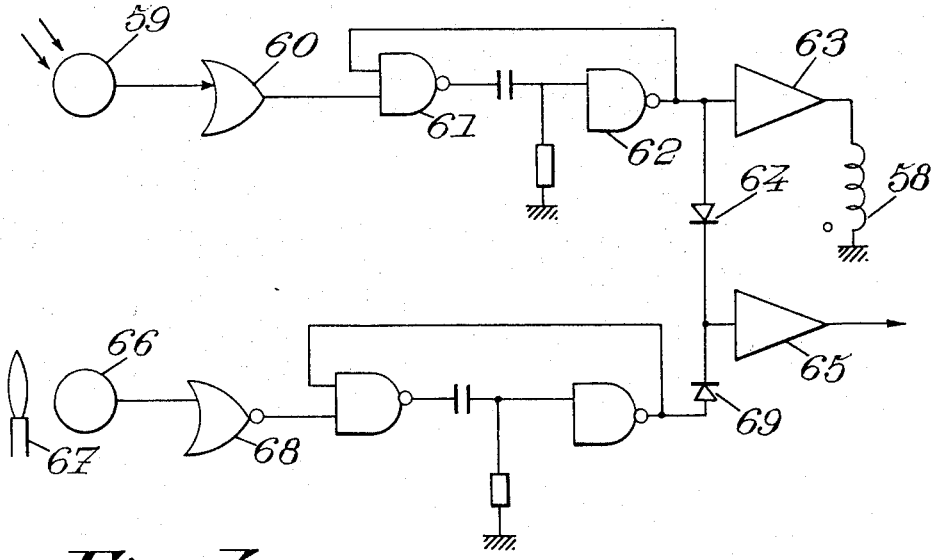
FIG. 4 is a diagram showing the principle of the ignition portion of said second device.

While the embodiments of FIGS. 1 and 2 are of the analogue type, that of FIGS. 3 and 4 employs substantially logic units.

FIG. 3, which shows the ignition portion of a circuit, also has a photo-sensitive element 50 which, when the level of lighting exceeds a given level, applies a rising front to a gate 51 connected as an inverter. The descending front provided by the gate 51 acts on a monostable element constituted by two NAND gates 52 and 53 relooped at 54 and coupled by a capacitor 55/ resistance 56 circuit, the value of which determines the time constant of the monostable element. The output interval of the monostable element is applied to a buffer amplifier 57 which feeds the winding 58 of the motor in the direction for closing the valve (not shown).

Similarly, FIG. 4 shows a circuit of the ignition portion; for ignition: when the level of light falls below a given value (i.e. below that which causes extinction), the photo-sensitive element 59 applies to the gate 60 a negative edge. This gate, connected like the gate 5 so that it is sensitive only to those variations in logic level at its input, controls a monostable element constituted substantially by two NAND gates 61 and 62 connected like the gates 52 and 53 in FIG. 3. The output of the second gate 62 controls a buffer amplifier 63 which supplies the winding 58 in the opposite direction to the buffer amplifier 57. Moreover, the output of the monostable element controls, through a diode 64, a second buffer amplifier 65 which operates a spark producing device which is similar to that of FIG. 2.

The buffer amplifier 65 is likewise controlled by a circuit for re-igniting the flame should it be extinguished. This circuit comprises a heat-sensitive element 66 operated by the flame from the nozzle 67. Like the element 50, the element 66 acts upon a circuit comprising a gate 68, connected as an inverter, and a monostable element. The output of the monostable element acts upon the buffer 65 through a diode 69. To avoid triggering of the ignition circuit if the flame is extinguished due to the gas supply being cut off by operation of the circuit of FIG. 3, there is, between the element 66 and the gate 68, another element (not shown) which avoids tripping of the gate 68 when extinction is required.

To the device in FIG. 4 may also be added a safety circuit functioning by counting sparks (one hundred, for example) and which interrupts the supply of gas if there is no ignition.

Other embodiments are possible, employing for example a SCHMITT trigger which determines the ignition and extinction thresholds. This trigger may comprise two cascade-connected NAND gates, the first of which is also acted upon by the light detector and the second by the output from the first. The second inputs of the two gates receive in one case a logic level representing the extinction threshold, and in the other a logic level representing the threshold of ignition.

In the circuits shown in FIGS. 3 and 4, components will be used which have low power consumption, for instance components used in "complementary MOSFET" technology.

In application to heating, a gas-fired appliance may be used either to effect heating directly by combustion of the gas or to bring about ignition of a liquid fuel.

Although in the embodiments described the circuits are supplied from a battery, the supply may be by other means, for example an accumulator which may be recharged by a set of thermocouples (not shown) the heat source of which is constituted by the flame.

I claim:

1. Device for automatically controlling a gaseous or liquid fuel fired appliance according to a parameter, comprising:

fuel supply means provided with valve means having a reversible electric motor, operation of which in one direction drives the valve means in the opening direction and in the opposite direction drives the valve means in the closing direction;

means sensitive to the said parameter to furnish an electrical signal which is a function of the value of the said parameter;

a first circuit adapted to be triggered by the said parameter-sensitive means when the value of the parameter exceeds a first threshold and adapted to supply the motor for a given period of time in the direction corresponding to closure of the valve means;

a second circuit adapted to be triggered by the said parameter-sensitive means when the value of the parameter falls below a second threshold which is lower than the first threshold, and adapted to supply the said motor then for a definite period in the direction corresponding to opening of the valve means;

a spark generator to ignite the combustible and adapted to be brought into operation by the said second circuit;

an inhibiting element adapted to stop the spark generator when the combustible is ignited, and first and second dc sources for independently and respectively supplying the first and second circuits;

the said first and second circuits being so arranged that outside the said definite period and the said predetermined period, their consumption of electric power is low.

2. Device according to claim 1, wherein the first and/or second circuit comprises an element sensitive to the said parameter, the resistance of which varies as a function of the parameter, the said element being disposed in series with an adjustable resistance and a controlled rectifier of low maintenance current, for example a thyristor in the base polarising circuit of a transistor, the said controlled rectifier being disposed in the collector circuit of the said transistor and the said parameter-sensitive element being so connected as to release the transistor when the parameter exceeds the value of the first threshold or falls below the value of the second threshold.

3. Device according to claim 2, wherein the said transistor, when conductive, closes the charging circuit of a storage capacitor, discharge of which through an adjustable resistance produces supply to the motor for a given period to move the valve means from the fully open position to the fully closed position or vice versa.

4. Device according to claim 3 comprising a threshold element, for example a Zener diode, adapted to start the controlled rectifier so as to interrupt charging of the storage capacitor as soon as the latter reaches a given value.

5. Device according to claim 1, comprising a circuit incorporating a resistance of a negative temperature coefficient and subject to the action of the flame to cause spark generation should the flame be extinguished while the said valve means is open.

6. Device according to claim 1, comprising means for stopping the supply of fuel in response to functioning of the spark generator during a period exceeding a given threshold.

7. Device according to claim 1, wherein the parameter-sensitive means is a photo-diode.

8. Device according to claim 1, wherein the parameter-sensitive means is a thermistor.

* * * * *